United States Patent [19]

Taylor

[11] Patent Number: 4,585,420

[45] Date of Patent: Apr. 29, 1986

[54] MOLDED RUBBER SKI ROPE HANDLE WITH CONTINUOUS CLOSED FINGER PROTECTOR

[76] Inventor: James H. Taylor, 601 Second Ave., Red Springs, N.C. 28377

[21] Appl. No.: 653,303

[22] Filed: Sep. 24, 1984

[51] Int. Cl.[4] ..... A63C 15/06

[52] U.S. Cl. ..... 441/69

[58] Field of Search ..... 441/65, 68, 69; 114/253; 116/110 R

[56] References Cited

U.S. PATENT DOCUMENTS

| | | | |
|---|---|---|---|
| 3,537,418 | 11/1970 | Brownson | 441/69 |
| 3,830,188 | 8/1974 | Humbert | 441/69 |
| 4,043,290 | 8/1977 | Holland | 441/69 |
| 4,060,049 | 11/1977 | Rumbaugh | 441/69 |
| 4,335,478 | 6/1982 | Pittman | 441/69 |
| 4,374,638 | 2/1983 | Presser | 441/69 |

*Primary Examiner*—Trygve M. Blix
*Assistant Examiner*—Stephen P. Avila
*Attorney, Agent, or Firm*—Mills and Coats

[57] ABSTRACT

The present invention relates to a ski rope handle assembly of the molded rubber type. The present invention is characterized by an external rope loop connection formed about each end of the handle that is offset from a fully closed finger protector sleeve. A pair of rope segments are wound about opposite ends of a ski rope handle in a continuous arcuate fashion so as to form external closed loops about each end of the handle adjacent to but not within the closed finger protector sleeves. The free end of the rope is merged with an intermediate segment of the rope just prior to extending forwardly through an opening formed in the finger protector sleeve. Thus, the rope loop formed is entirely external to the ski rope handle assembly and is offset from the finger protector sleeve.

2 Claims, 3 Drawing Figures

MOLDED RUBBER SKI ROPE HANDLE WITH CONTINUOUS CLOSED FINGER PROTECTOR

FIELD OF INVENTION

The present invention relates to ski rope handles and ski rope handle assemblies, and more particularly to ski rope handle assemblies of the molded plastic type.

BACKGROUND OF INVENTION

Molded rubber ski rope handle assemblies are known in the art and are widely used by water ski enthusiasts throughout the United States and the world. These molded ski rope handle assemblies are functional and perform very satisfactorily. There is, however, some area of concern for the manufacturers of such molded ski rope handle assemblies. One area of concern deals with the tearing or fraying of the ski rope adjacent to openings formed in the ski rope handle through which the ski rope extends. One cause of this problem is the edge of the opening itself cutting into the rope. This cause, however, is easily prevented by providing the opening with a grommet. A more significant cause is that the rope is, in many instances, required to bend sharply prior to entering an opening placing excessive stress on the rope at point of bending.

Therefore, there is a need for a ski rope handle assembly that is particularly designed to eliminate the excessive stress caused by bending the rope sharply to insert the same into an opening formed in the ski rope handle assembly.

SUMMARY AND OBJECTS OF INVENTION

The present invention relates to a ski rope handle assembly design that is intended to eliminate excessive stress caused by unneeded bending. Moreover, the ski rope assembly design is intended to produce a very functional and reliable molded ski rope assembly that is relatively easy to manufacture.

In this regard, the present invention discloses a molded ski rope handle assembly wherein the same is characterized by an external offset rope loop connection formed about each end of the handle that is offset from the finger protector sleeve. A pair of rope segments are wound about opposite ends of a ski rope handle in a continuous arcuate fashion so as to form an external closed loop about the handle adjacent to the finger protector sleeves. The free end of rope is merged with an intermediate segment of the rope, which extends forwardly through an opening in the finger protector sleeve just prior to extending into said opening. It is apparent that because the rope loop is formed adjacent to but not within the finger protector sleeve, the rope loop need not pass through a transverse opening in the finger protector sleeve and need not bend excessively causing unneeded stress in the rope at the point of bending.

Accordingly, it is an object of the present invention to provide a ski rope handle assembly of a molded type that is particularly designed to eliminate excessive stress in the ski rope caused by excessive bending in the ski rope.

A further object of the present invention is to achieve the preceding object with an external rope loop connection in which the rope loop does not pass through the finger protector sleeve.

Another object of the present invention is to achieve the preceded objects with a ski rope handle assembly design that is relatively easy to manufacture and assemble and which will retain the desirable functional qualities of molded ski handle assemblies.

Still another object of the present invention is to achieve the preceded objects with a ski rope handle assembly that is durable, reliable and easy to use.

Other objects and advantages of the present invention will become apparent from a study of the following description and the accompanying drawings which are merely illustrative of such invention.

DESCRIPTION OF INVENTION

Figure 1:
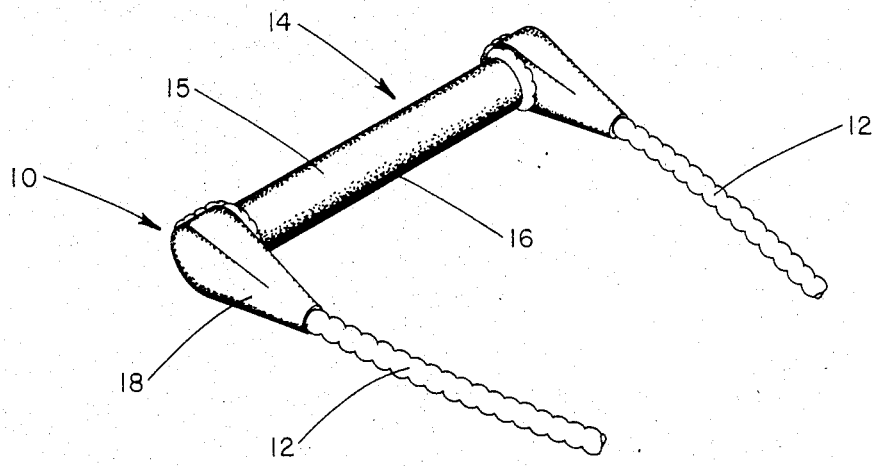
FIG. 1 is a perspective view of the molded ski rope handle of the present invention.
Figure 2:
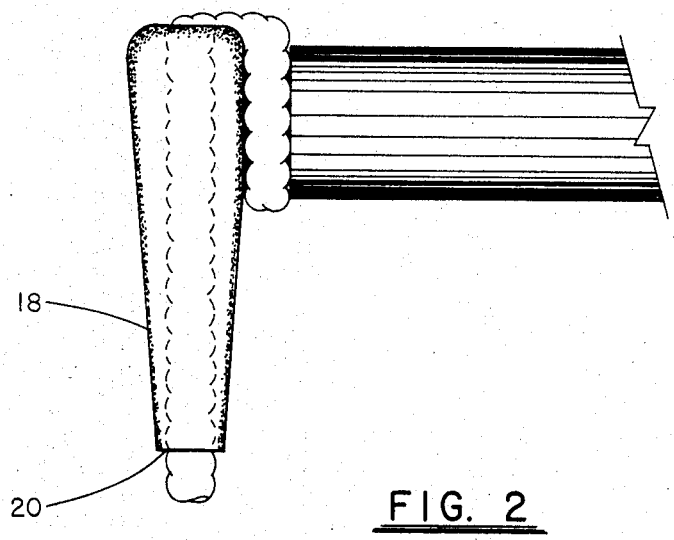
FIG. 2 is a fragmentary top elevational view of the molded ski rope handle of the present invention.
Figure 3:
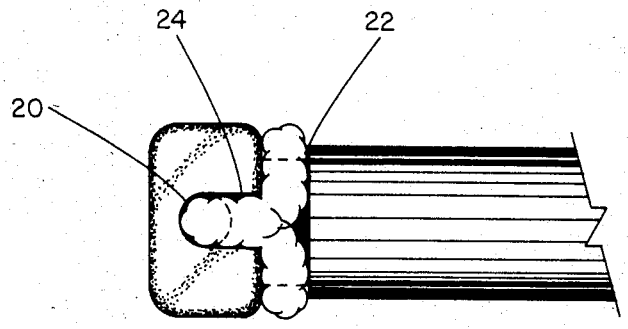
FIG. 3 is a fragmentary rear elevational view of the molded ski rope handle of the present invention.

With further reference to the drawings, the ski rope handle assembly of the present invention is shown therein and indicated generally by the numeral 10. Ski rope handle assembly 10 includes a rope 12 coupled or secured to opposite ends of a ski rope handle, indicated generally by the numeral 14. Ski rope handle 14 includes an elongated core 15 which may preferably be a hollow cylindrical metal tube. It is appreciated that core 16 would include an elongated axis that would extend from end of handle 14 to the other. A molded rubber covering 16 is formed about and encloses core 15 and provides a friction surface which can be easily grasped.

Integrally formed about each end of handle 14 is a closed finger protector sleeve 18 that is likewise made of molded rubber. The finger protector sleeve 18 extends forwardly from each end of handle 14 to form a pair of finger-like projections. A rope opening 20 extends from the forward end of each finger-like projection through said finger protector sleeve 18 on an axis that is normal to the elongated axis of handle 14.

In addition, a pair of rope channels 22 are formed about handle 14 and extend cicumferentially around the same adjacent to respective finger protector sleeves 18. A second rope channel 24 is formed in the rear of each finger protector sleeve 18 and extends from the rope opening 20 formed therein to the rope channel 22 encircling handle 14.

As illustrated in the drawings, rope 12 is attached to handle 14 through an external rope loop connection. Rope 12 is initially looped around handle 14 within a respective rope channel 22 and then threaded into itself to form a closed loop encircling handle 14. The free end of rope 12 is then threaded through rope opening 20 in finger protector sleeve 18 so that it extends forwardly from the finger protector sleeve 18 upon emerging from the rope opening 20. It is appreciated that when the rope 12 is pulled taut an intermediate portion of rope 12 extending from the closed loop will be drawn into the second rope channel 24. Thus, the end of the rope which is threaded into itself merges with the intermediate portion of the rope as it extends through second rope channel 24 and into rope opening 20. The length of the second rope channel 24 effectively forms a gentle arc upon which the rope 12 must bend so as not to cause acute bending and thereby reduces strain on the rope 12.

From the foregoing specification, it is appreciated that the present invention presents a new and useful ski rope handle assembly that is especially designed to give greater strength to both the ski rope handle and the ski rope itself. In addition, the present invention presents a ski rope handle assembly that can be easily and conveniently manufactured and assembled.

What is claimed is:

1. A ski rope handle and rope assembly wherein the ski rope is coupled to each end of said handle through an offset loop configuration, said ski rope handle and rope assembly comprising: an elongated ski rope handle having an elongated axis, a hollow metal core and a molded rubber surface covering formed about and enclosing said core; a finger protection sleeve formed about each end of said ski rope handle and extending forwardly therefrom, each said finger protection sleeve including a rope opening that extends therethrough at an angle normal to the elongated axis of said ski rope handle; a pair of first rope channels extending circumferentially around said ski rope handle adjacent respective finger protector sleeves; a pair of second ski rope channels formed in the rear of said finger protector sleeves and extending between in a plane generally parallel to said elongated axis and interconnecting said first rope channels and said rope openings; a pair of rope segments that extend to and couple with opposite ends of said handle through an external loop configuration, each external loop configuration including a single rope loop wound around said handle within said respective first rope channels in a continuous arcuate fashion so that said rope loop is centrally open about said ski rope handle and an intermediate rope segment extending laterally through said second rope channel from said rope loop and then forwardly through said rope opening formed in said finger protector sleeve; and wherein each said rope segment includes an end portion which merges with said intermediate rope segment just prior to extending laterally into said second rope channel so as to form said rope loop.

2. The ski rope handle and rope assembly of claim 1 wherein said ski rope handle is of integral construction inasmuch as said finger protector sleeves are integrally molded with said elongated handle.

* * * * *